United States Patent [19]

Bessinger et al.

[11] Patent Number: 4,765,699

[45] Date of Patent: Aug. 23, 1988

[54] DRAWER SLIDE LIFT-OUT LOCK

[75] Inventors: Walter L. Bessinger, Grand Haven; Gene R. Clement, Grandville, both of Mich.

[73] Assignee: Knape & Vogt Manufacturing Company, Grand Rapids, Mich.

[21] Appl. No.: 11,789

[22] Filed: Feb. 6, 1987

[51] Int. Cl.[4] ..... A47B 88/00

[52] U.S. Cl. ..... 312/339; 312/348

[58] Field of Search ..... 312/348, 338, 339, 340; 16/82; 49/335

[56] References Cited

U.S. PATENT DOCUMENTS

| | | | |
|---|---|---|---|
| 1,301,495 | 4/1919 | Otte | 312/338 |
| 1,692,805 | 11/1928 | Anderson | 312/337 |
| 2,346,167 | 4/1944 | Jones et al. | 312/340 |
| 2,625,455 | 1/1953 | Mitten | 312/348 |
| 2,655,422 | 10/1953 | Gussack | 312/333 |
| 2,859,070 | 11/1958 | Gomersall | 312/333 |
| 2,981,584 | 4/1961 | Friend | 312/337 |
| 3,092,429 | 6/1963 | Barnes | 312/333 |
| 3,123,419 | 3/1964 | Maxwell | 312/333 |
| 3,194,623 | 7/1965 | Burgess | 312/333 |
| 3,259,447 | 7/1966 | Deutsch | 312/348 |
| 3,589,778 | 6/1971 | Olson | 312/348 |
| 3,748,011 | 7/1973 | Hazzard et al. | 312/333 |
| 3,782,800 | 1/1974 | Remington et al. | 312/333 |
| 3,954,315 | 5/1976 | Sanden | 312/333 |
| 4,441,772 | 4/1984 | Fielding et al. | 312/333 |
| 4,469,384 | 9/1984 | Fler et al. | 312/333 |
| 4,473,262 | 9/1984 | Staye | 312/333 |

*Primary Examiner*—Kenneth J. Dorner
*Assistant Examiner*—Gerald A. Anderson
*Attorney, Agent, or Firm*—Price, Heneveld, Cooper, DeWitt & Litton

[57] ABSTRACT

The specification discloses a lift-out drawer slide having a lock to positively prevent accidental or inadvertent removal of the drawer from the cabinet. As is conventional in lift-out slides, the drawer rail can be vertically cocked with respect to the supporting rail to bypass the stop mechanism and remove the drawer. The present slide includes a movable lock which can be positioned within the clearance space between the rails to prevent relative cocking of the rails and thereby prevent bypassing of the stop mechanism.

16 Claims, 2 Drawing Sheets

DRAWER SLIDE LIFT-OUT LOCK

BACKGROUND OF THE INVENTION

The present invention relates to drawer slides and more particularly to drawer slides permitting the drawer to be removed from the cabinet opening.

A wide variety of drawer slides has been developed for slidably supporting a drawer within a cabinet. A pair of such slides are used on opposite sides of the drawer. Each slide includes a drawer rail secured to the drawer, a cabinet rail secured to the cabinet, and roller means for slidably interfitting the rails. Often, intermediate rails are provided between the drawer and cabinet rails, permitting the drawer to be fully extended from the cabinet opening. Stop mechanisms are provided on the drawer slides to limit the movement of the drawers between fully closed and fully open positions.

Often, the slides include a release mechanism for overcoming or bypassing the stop mechanism and thereby permitting the drawer to be removed from the cabinet to service the cabinet, drawer, and/or slide or to retrieve articles which have fallen out of the drawer into the cabinet. One particularly successful such slide is that sold by Knape & Vogt Manufacturing Company (the assignee of the present application) of Grand Rapids, Michigan as its Model No. 1428 three-part slide. This slide is a "lift-out" slide wherein the stop mechanism includes a tab which depends downwardly from the drawer rail to engage a tab on the intermediate rail to prohibit movement past "full extension". A clearance is provided between the two rails permitting the drawer rail to be vertically cocked or canted with respect to the intermediate rail. Upon cocking, the drawer rail tab is lifted above the intermediate rail tab; and the drawer rail and drawer can be removed. Although constituting a significant advance, this slide suffers cne drawback. Specifically, the drawer can be inadvertently removed from the drawer cabinet if the drawer is accidentally lifted at its full extension from the cabinet. Fortunately, this usually occurs only when the drawer is lightly loaded. This of course can be extremely inconvenient, awkward, and even disruptive since the user is typically not prepared to handle the drawer upon its inadvertent removal from the cabinet.

Attempts to add positive locks to lift-out slides have not been particularly successful. These locks have proven difficult to operate and/or extend beyond the lateral confines of the slide, interfering with the operation of the drawer.

SUMMARY OF THE INVENTION

The aforementioned problems are overcome in the present invention wherein a lock is provided for a lift-out drawer slide to prevent inadvertent or accidental removal of the drawer from the cabinet. The lock comprises a movable mechanism within the lateral confines of the slide for selectively preventing relative cocking of the rails to insure that the stop means remains in positive engagement in the fully extended position.

In the specific embodiment disclosed, the lock includes a body portion removably positioned in the clearance space between the drawer rail and the supporting rail. In the locked position, the body portion is located within the clearance space to prevent relative cocking of the rails and thereby prevent accidental removal of the drawer. In the unlocked position, the body portion is located outwardly of the clearance space permitting the drawer rail to be cocked in conventional fashion to permit removal of the drawer.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
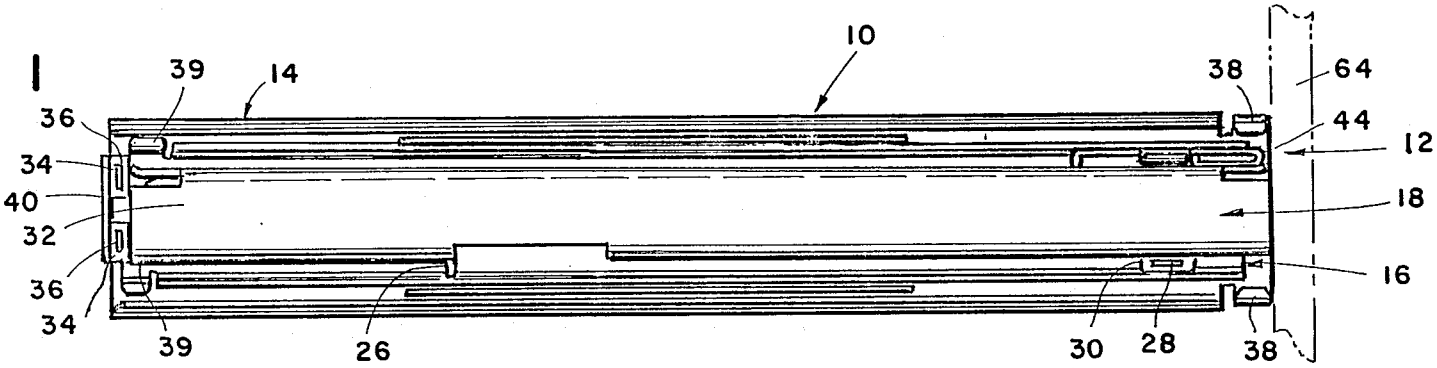
FIG. 1 is a side elevational view of the present slide in the fully retracted or closed position.

The lift-out drawer slide and lock of the present invention are illustrated in the drawings and generally designated 10 and 12 respectively. The drawer slide 10 is a three-part slide including a cabinet rail 14, an intermediate rail 16, and a drawer slide 18. The intermediate rail 16 is slidably supported on the cabinet rail 14; and the drawer rail 18 is slidably supported on the intermediate rail 16. As will be described, stop means are included on the various slide members to limit relative longitudinal sliding movement of the rails. The lift-out lock 12 is supported by the intermediate rail 16 and releasably fills the clearance space 20 between the intermediate rail 16 and the drawer rail 18. When in the "locked" position (FIG. 3) the lock fills the clearance space 20 and prevents cocking of the drawer rail 18. When in the "unlocked" position (FIGS. 4 and 5), the lock is clear of the space 20 permitting relative cocking of the drawer rail 18 with respect to the intermediate rail 16.

With the exception of the lift-out lock 12 and the means of supporting this lock, the drawer rail 10 is generally well known to those having ordinary skill in the art. One such slide is the above-identified Knape & Vogt Model 1428 three-part slide. Briefly summarizing, the slide includes a cabinet rail 14, an intermediate rail 16, and a drawer rail 18. Each of the rails is generally C-shaped in cross section including a web and a pair of flanges extending outwardly therefrom in a common direction. The flanges cooperate with balls, rollers, or other rotatable means to slidably interfit the rails for relative longitudinal movement. In the Knape & Vogt slide, balls are interfitted between the flanges on the cabinet and intermediate rails to slidably interfit these two members; and rollers 22 and 24 are rotatably supported on the intermediate rail 16 to support the drawer rail 18.

Relative longitudinal movement of the drawer rail 18 with respect to the intermediate rail 16 is limited in conventional fashion by stop means. The drawer rail 18 includes an integral downwardly depending finger 26; and the intermediate rail 16 includes an integral tab 28 which engage one another when the drawer rail 18 is in the fully extended position (FIGS. 2–4) to prevent further movement. Preferably, a polymeric or rubber bumper 30 is mounted in the tab 28 to absorb shock between the finger 26 and the tab. Retracting or closing movement of the drawer slide 18 is limited (FIG. 1) when the rear end 32 of the drawer rail 18 engages rubber bumpers 34 carried on integral tabs 36 extending from the intermediate rail 16.

In like fashion, relative longitudinal movement of the intermediate rail 16 with respect to the cabinet rail 14 is limited by stop means. The extended or open position of the intermediate rail (FIG. 3) is limited when the ball retainer (not shown) between the cabinet slide 14 and the intermediate slide 16 is engaged at its opposite ends by the integral tab 38 extending from the cabinet rail 14 and the integral tab 39 (see FIG. 1) extending from the intermediate rail 16. Retracting or closing movement of the intermediate rail 18 is limited when the rubber bumpers 34 engage the integral tab 40 extending from the cabinet rail 14. The intermediate rail 16 can be removed from the cabinet rail 14 only by removing the balls and retainer (not shown) between these two elements. This is difficult and is typically not performed outside of the factory.

Figure 9:
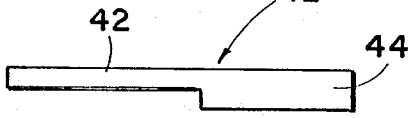
FIG. 9 is a top plan view of the lift-out lock.
Figure 8:
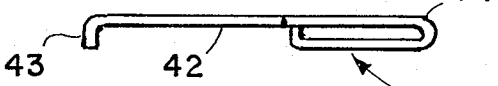
FIG. 8 is a side elevational view of the lift-out lock.

FIGS. 8–9 detail the construction of the lift-out lock 12. The preferred lift-out lock 12 is fabricated from an integral piece of approximately 0.025 inch thick cold-rolled annealed spring steel and includes a leg portion 42 and a body portion 44. An integral finger 43 extends perpendicularly from the leg 42 opposite the body 44. As seen in FIG. 9, the width of the leg 42 is approximately ½ the width of the body portion 44. The body portion is formed of a closed loop of the spring-steel stock which is elongated in the axial direction of the lock 12.

Figure 4:
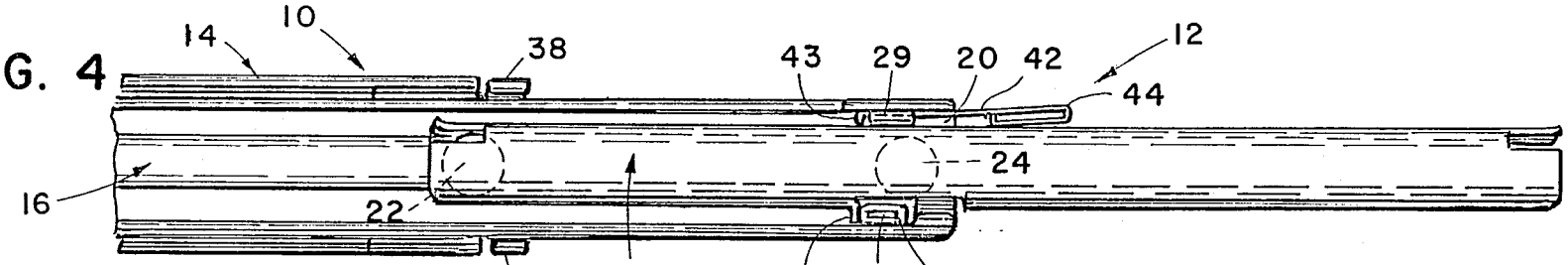
FIG. 4 is a fragmentary side elevational view of the slide with the lift-out lock in the unlocked position.
Figure 5:
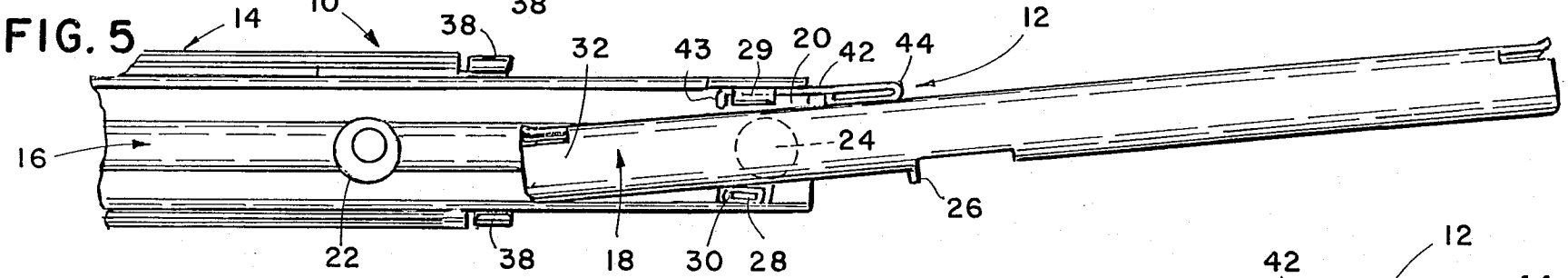
FIG. 5 is a fragmentary side elevational view of the slide with the drawer rail cocked and partially withdrawn from the intermediate slide.
Figure 7:
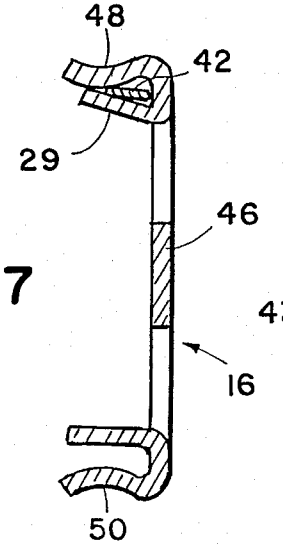
FIG. 7 is a sectional view taken along plane VII—VII in FIG. 6.
Figure 6:
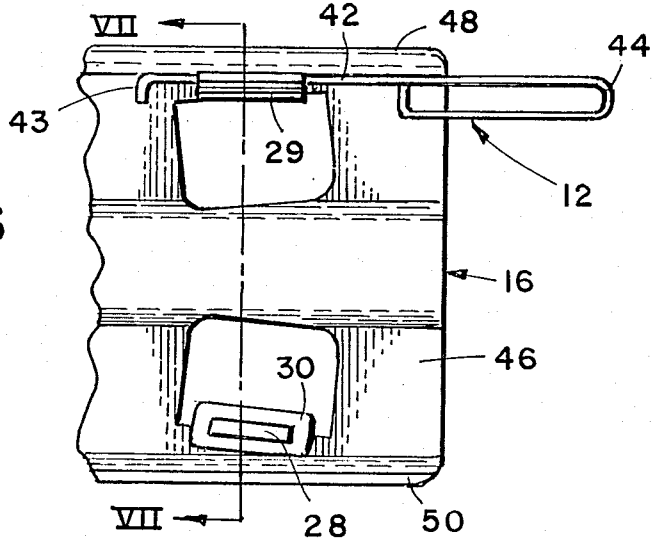
FIG. 6 is an enlarged fragmentary side elevational view of the intermediate rail and lift-out lock.

The mounting or securement of the lift-out lock 12 is illustrated in FIGS. 6 and 7. The intermediate rail 16 includes a web portion 46 and upper and lower flanges 48 and 50, respectively extending therefrom in a generally common direction. Both of the flanges 48 and 50 are generally arcuate to define ball races to receive the balls (not shown) interfitting the intermediate and cabinet rails. A pair of integral tabs 28 and 29 are bent from the web portion 46. The lower tab 28 carries the polymeric bumper 30 to act as a portion of the stop means as previously described. The upper tab 29 is used to mount the lift-out lock 12 on the intermediate rail 16. The functions of the tabs 28 and 29 are reversed in the opposite handed slide wherein the intermediate slide 16 is inverted. The lift-out lock lies adjacent the underside of the upper flange 48. The upper tab 29 is bent or staked against the upper flange (see in particular FIG. 7) to secure the leg 42 between the flange and the tab. The width of the leg 42 is sufficiently narrow so that the lock is free to slide between the flange 48 and the tab 29 between a locked position (FIGS. 1–3) and an unlocked position (FIGS. 4 and 5). In the locked position, the body portion 44 engages the tab 29; and in the fully unlocked position, the finger 43 engages the opposite side of the tab 29. The width of the lock 12 and its axial movement insure that the lock remains within the lateral confines of the slide 10 at all times.

Figure 3:
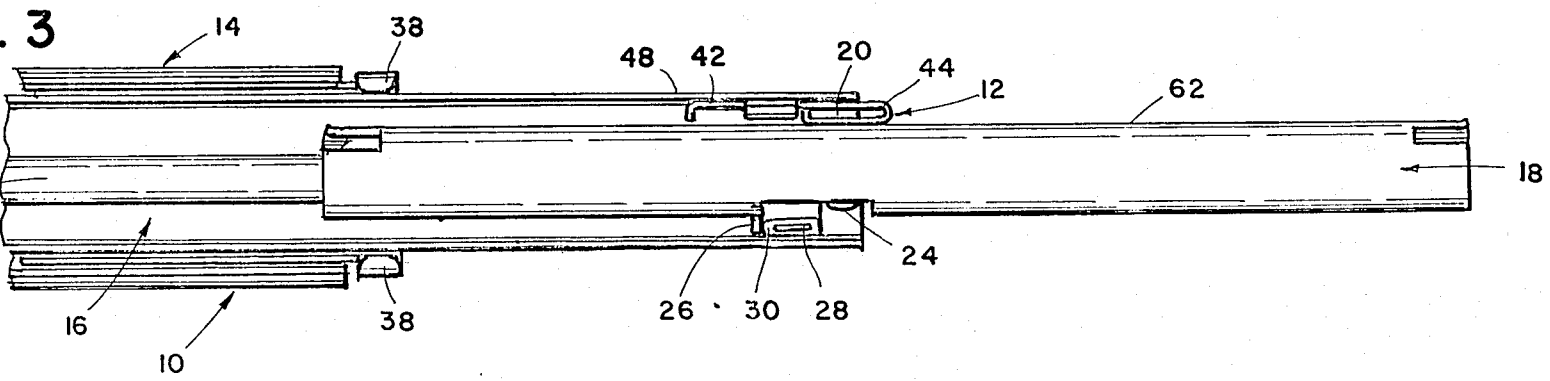
FIG. 3 is a fragmentary side elevational view of the slide with both the drawer and intermediate rails in the fully extended position.

As perhaps best illustrated in FIG. 3, the height of the lock body portion 44 closely approximates the vertical distance between the upper flange 48 of the intermediate rail 16 and the upper flange 62 of the drawer rail 18. The distance between the upper flanges on the intermediate and drawer rails is referred to as the clearance space and is designated 20.

Operation

Figure 2:
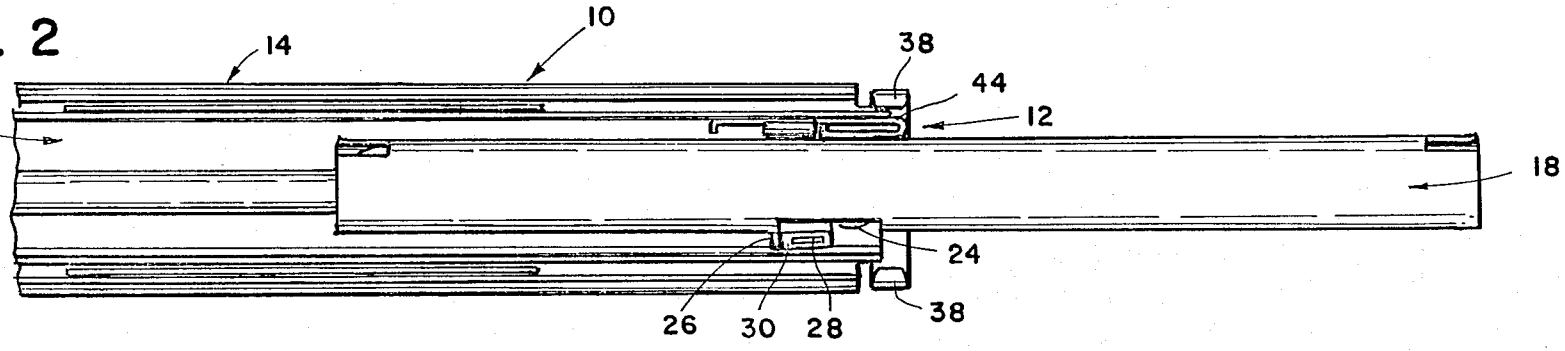
FIG. 2 is a fragmentary side elevational view of the slide with the drawer rail in the fully extended position.

FIGS. 1–3 illustrate the position of the lock 12 in the locked position wherein the body portion 44 is located within the clearance space 20 between the upper flanges of the intermediate and drawer rails. When in this position, the lock occupies or fills the space 20 to positively prevent the drawer rail 18 from being moved to its cocked position wherein the stop mechanism 26 and 28 becomes disengaged. The lock therefore prevents inadvertent removal of the drawer which is supported directly by the drawer rails 18.

The fully retracted or closed position of the slide is illustrated in FIG. 1 wherein the rear end 32 of the drawer rail 18 engages the bumpers 36; and the bumpers 36 in turn engage the tab 40. The drawer rail 18 is shown fully extended from the intermediate rail 16 in FIG. 2 wherein the finger 26 engages the bumper 30 on the tab 28. As the drawer is withdrawn from the cabinet, the drawer rail 18 typically travels to its fully extended position as illustrated in FIG. 2 before movement of the intermediate rail begins. Both the drawer rail 18 and intermediate rail 16 are illustrated in their fully extended positions in FIGS. 3 and 4. The finger 26 continues to engage the bumper 30 limiting extension of the drawer rail. The stop means between the intermediate and cabinet rails limits further extension of the intermediate rail.

FIGS. 4 and 5 illustrate the release of the drawer rail from the intermediate rail 16. After the drawer rail 18 and intermediate rails 16 have been fully extended (FIG. 3 , the lock 44 is slid to its unlocked position (FIGS. 4 and 5) wherein the finger 43 engages the tab 29. In this position, the body portion 44 is located forwardly of the intermediate rail 16 such that no portion of the body remains in the clearance space 20 between the upper flanges on the intermediate and drawer rails. With the lock 12 in the unlocked position, the drawer rail 18 can be vertically cocked or canted to lift the finger 26 a sufficient height to clear the tab and bumper 28 and 30. With the finger clear of the stop, the drawer rail 18 can be drawn forwardly and removed from the intermediate rail 16.

To replace the drawer within the cabinet, these steps are performed in reverse. The drawer rail 18 is fitted over the forward roller 24 and slide into the intermediate rail 16. As the rear end 32 of the drawer rail 18 passes over the roller 22, the drawer rail 18 is slightly cocked or elevated so that the finger 26 can pass over the stop 28 and 30. After the finger has passed the stop, the drawer rail 18 is lowered to its normal position wherein it is linearly aligned with the intermediate rail 16. Lock 44 is then pushed back to the locked position wherein the body 44 abuts the tab 29. If the user forgets or does not desire to positively return the lock 44 to its locked position, the drawer 64 will automatically do so when pushed into the cabinet forcing the slide into its fully closed position (see FIG. 1).

The lift-out lock of the present invention positively prohibits the accidental or inadvertent removal of the drawer from a cabinet. Specifically, the body portion of the lock fills the clearance space between the intermediate and drawer rails, preventing the drawer rail from being cocked or canted as necessary to overcome the stop mechanism. However, the drawer can still be easily removed from the cabinet by first moving the lift-out locks 44 to the unlocked position wherein canting of the drawer rails is permitted.

The above description is that of a preferred embodiment of the invention. Various alterations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A drawer slide comprising:

a drawer rail including a web and upper and lower integral flanges extending therefrom;

a second rail including a web and upper and lower integral flanges extending therefrom and a tab extending from said web;

roller means for slidingly interfitting said drawer rail and said second rail for relative longitudinal movement, said drawer rail flanges cooperating with said roller means to support said drawer rail on said second rail;

stop means on said drawer and second rails for limiting the relative longitudinal movement of said drawer and second rails;

said upper and lower drawer rail flanges being located vertically between said upper and lower second rail flanges, said upper flanges of said drawer and second rails defining a clearance therebetween permitting said drawer rail to be vertically cocked with respect to said second rail to disengage said stop means; and lock means for selectively preventing cocking of said drawer slide with respect to said second slide, said lock means comprising a movable lock having a leg slidingly entrapped between said upper second rail flange and said tab, said lock further having a body extending from said leg, said lock being longitudinally movable with respect to said rails between a locked position wherein said body is located within said clearance between said upper flanges and an unlocked position wherein said body is located outwardly of said clearance.

2. A drawer slide as defined in claim 1 wherein said lock is fabricated of a resiliently deflectable material.

3. A drawer slide as defined in claim 2 wherein said body comprises a loop integral with said leg.

4. A drawer slide as defined in claim 1 wherein said slide is a three-rail slide wherein said second rail is the intermediate rail.

5. A drawer slide as defined in claim 4 wherein said upper and lower second rail flanges define ball races.

6. An improved drawer slide including first and second rails, antifriction means for slidingly interfitting said rails in linear alignment for relative longitudinal movement, and cooperating catch means on said rails for preventing said rails from being fully withdrawn from one another, said catch means being effective when said rails are linearly aligned, said catch means being released when said rails are nonlinearly aligned, the improvement comprising a lock means on at least one of said first and second rails and within the lateral confines of said slide for selectively preventing said rails from being moved to a nonlinearly aligned state and thereby for preventing releasing of said catch means, said lock means being movable between a locked position maintaining said rails in linear alignment and an unlocked position enabling said rails to be nonlinearly aligned to release said catch means.

7. An improved drawer slide as defined in claim 6 wherein:

said first and second rails include first and second flanges, respectively, said rails being parallel and defining a clearance space therebetween when said rails are slidingly interfitted; and said lock means includes a body portion having a locked position within said clearance space and an unlocked position out of said clearance space.

8. An improved drawer slide as defined in claim 7 wherein said lock means is slidable in a direction parallel to said flanges between said locked and unlocked positions.

9. An improved drawer slide as defined in claim 8 wherein:

one of said rails includes an integral tab; and said lock means includes a leg slidingly secured between said tab and the flange on said one rail.

10. An improved drawer slide as defined in claim 9 wherein said lock means is fabricated from a resiliently deformable material.

11. An improved drawer slide as defined in claim 10 wherein said body comprises a loop of said material integral with said leg.

12. A drawer slide comprising:

a drawer rail to be mounted on a drawer;

a second rail;

bearing means for slidably supporting said drawer rail in linear alignment with said second rail for relative longitudinal movement;

stop means for preventing said drawer rail from being fully withdrawn from said second rail, said catch means being effective when said rails are slidably interfitted and linearly aligned, said catch means being releasable by vertically cocking said drawer rail with respect to said second rail; and lock means for preventing inadvertent releasing of said catch means, said lock means having a first locked position preventing cocking of said drawer rail and a second unlocked position enabling said drawer rail to be cocked.

13. A drawer slide as defined in claim 12 wherein each of said drawer and second rails comprise webs and an integral flange extending therefrom, said flanges being generally parallel to one another when said drawer rail is supported on said second rail and defining a clearance space therebetween, said lock means including a portion located within said clearance space in the locked position and out of said clearance space in the unlocked position.

14. A drawer slide as defined in claim 13 wherein said lock means is longitudinally slidable with respect to said rails between the locked and unlocked positions.

15. A drawer slide as defined in claim 14 wherein one of said rails includes an integral tab, said lock means including a leg slidably received and retained between said tab and said one rail flange.

16. A drawer slide as defined in claim 15 wherein said body portion and said leg are fabricated of an integral piece of resiliently deformable material.

* * * * *